US006148579A

United States Patent [19]

Rolf

[11] Patent Number: 6,148,579

[45] **Date of Patent: *Nov. 21, 2000**

[54] PREFABRICATED WOOD TRUSSES WITH PRE-BRACED COMPRESSION WEB MEMBERS

[75] Inventor: Mark R. Rolf, Spring, Tex.

[73] Assignee: Trussway Partners, Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/040,711

[22] Filed: Mar. 18, 1998

[51] Int. Cl.[7] ..... E04C 3/02

[52] U.S. Cl. ..... 52/639; 52/690; 52/730.7; 52/731.7; 403/232.1

[58] Field of Search ..... 403/283, 232.1; 52/737.3, 690, 639, 481.1, 731.7, 636, 691–698; 411/457, 461, 462, 466

[56] References Cited

U.S. PATENT DOCUMENTS

| | | | |
|---|---|---|---|
| 939,749 | 11/1909 | Sagendorph . | |
| 1,609,541 | 12/1926 | Gooding . | |
| 2,178,388 | 10/1939 | Beckman . | |
| 3,225,643 | 12/1965 | Couch . | |
| 3,286,429 | 11/1966 | Ratliff, Jr. | 52/727 |
| 3,309,833 | 3/1967 | Jureit | 52/691 |
| 4,031,686 | 6/1977 | Sanford | 52/693 |
| 4,274,241 | 6/1981 | Lindal | 52/642 |
| 4,275,537 | 6/1981 | Pinson | 52/223 |
| 4,442,649 | 4/1984 | Birckhead et al. | 52/693 |
| 4,490,956 | 1/1985 | Palacio et al. | 52/639 |
| 4,546,579 | 10/1985 | Rionda et al. | 52/92 |
| 4,555,887 | 12/1985 | Rionda et al. | 52/712 |
| 4,653,242 | 3/1987 | Ezard | 52/727 |
| 4,738,071 | 4/1988 | Ezard | 52/741 |
| 4,862,667 | 9/1989 | Melland | 52/732 |
| 5,234,279 | 8/1993 | Poutanen | 403/403 |
| 5,454,201 | 10/1995 | Slonim | 52/639 |
| 5,648,138 | 7/1997 | Tingley | 428/105 |
| 5,896,716 | 4/1999 | Jalla | 52/514 |
| 5,946,879 | 9/1999 | Pellock | 52/690 |

OTHER PUBLICATIONS

Truss Plate Inst., "Handling, Installing & Bracing Metal Plate Connected Wood Trusses, HIB–91," 1991.

Truss Installation and Bracing Notes, Trussway Ltd., Publication #112493.

*Primary Examiner*—Richard Chilcot

*Attorney, Agent, or Firm*—Sue Z. Shaper; Felsman, Bradley, Vaden Gunter & Dillon, LLP

[57] ABSTRACT

A prefabricated wood truss with pre-braced compression webs comprising a pre-installed wood truss having at least one reinforcing brace attached along at least a portion of a length of an interior wood web member structured to be placed in compression.

16 Claims, 11 Drawing Sheets

FIG. 6
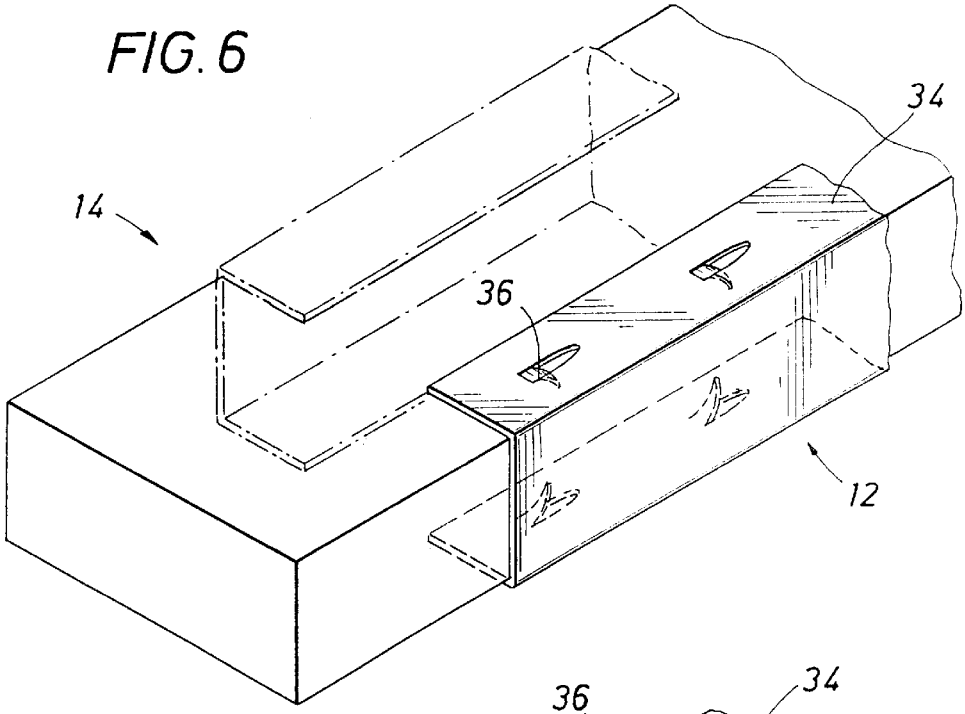
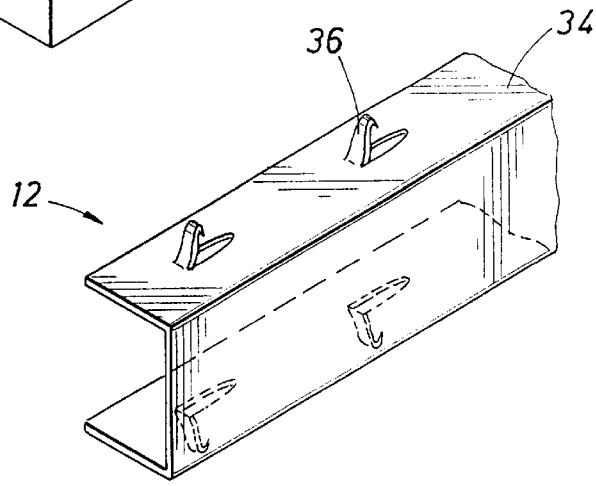
FIG. 7
FIG. 8
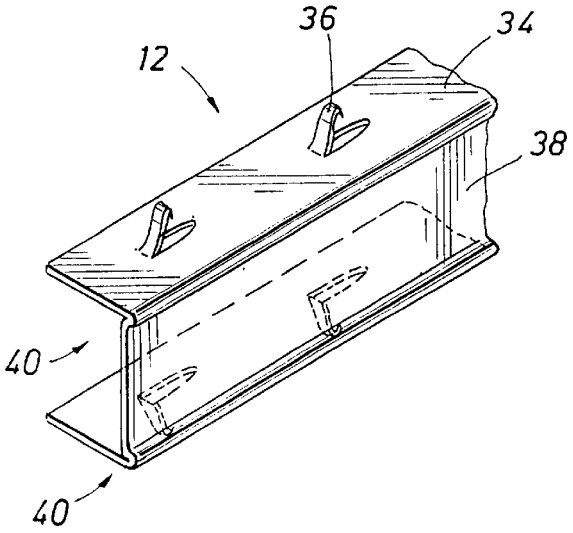
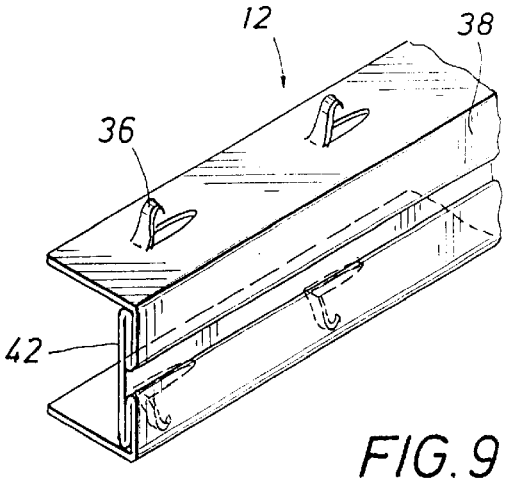
FIG. 9

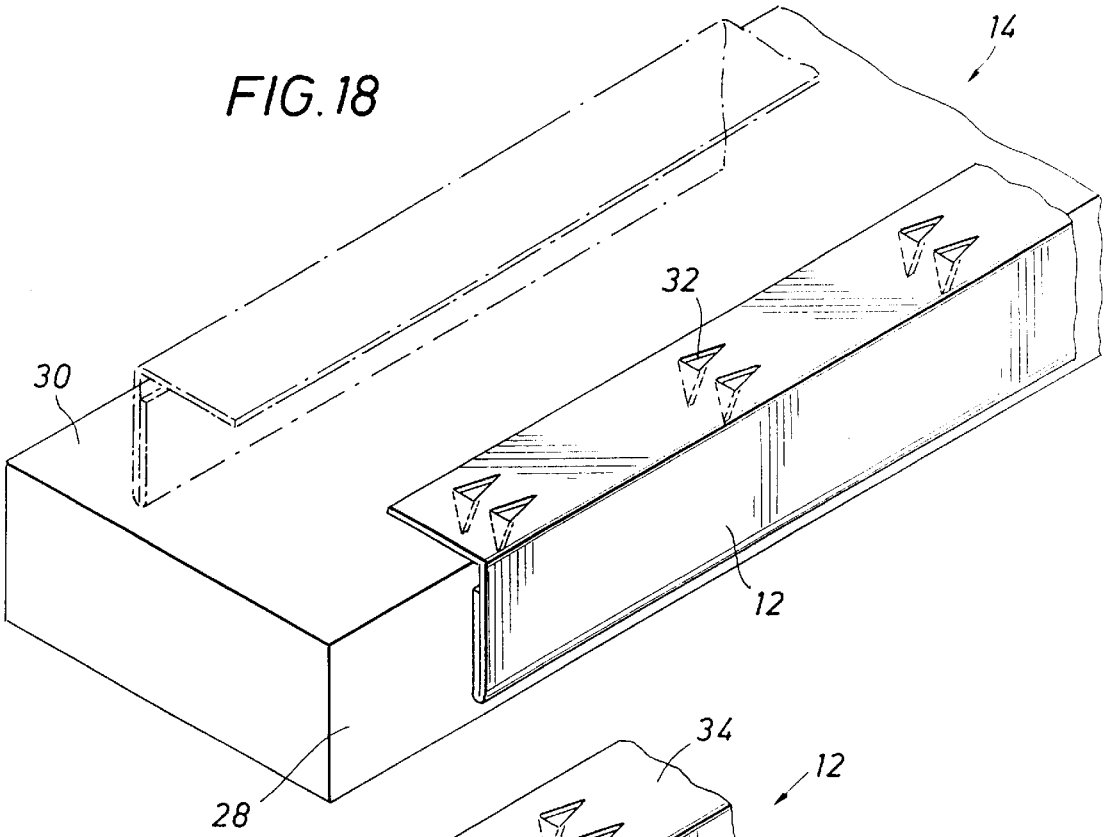
FIG. 18
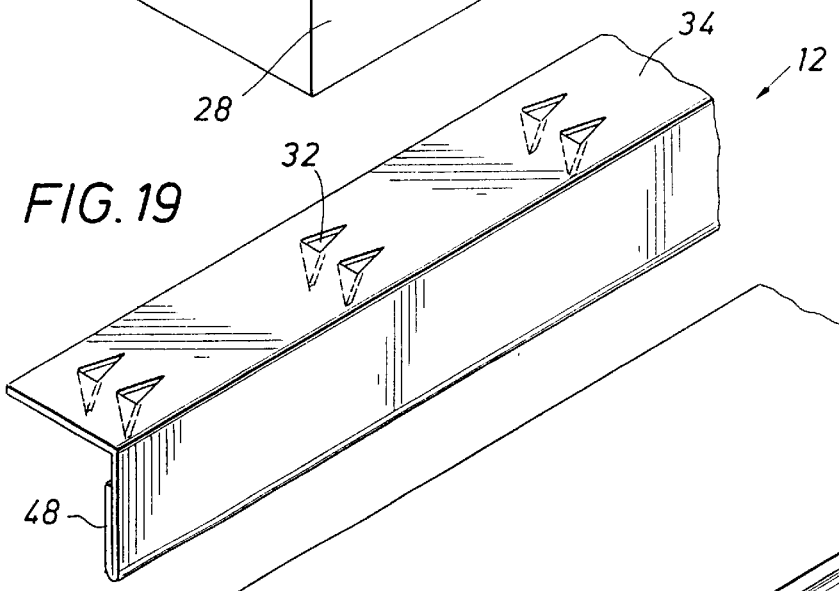
FIG. 19
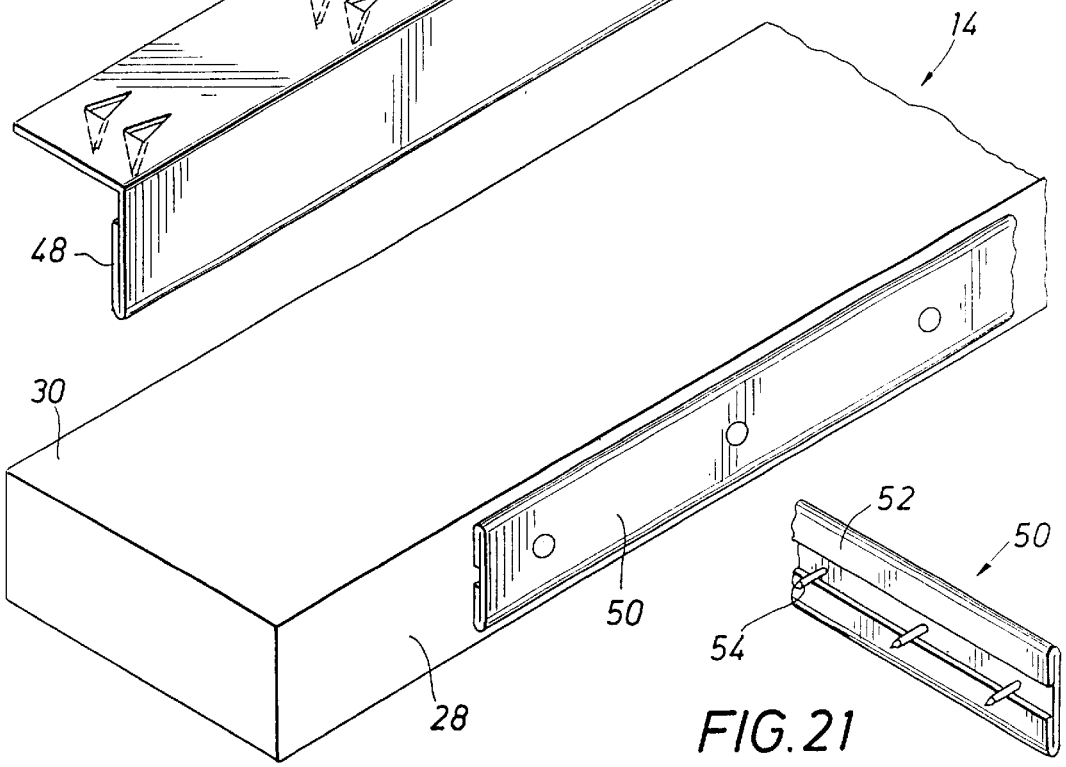
FIG. 20
FIG. 21

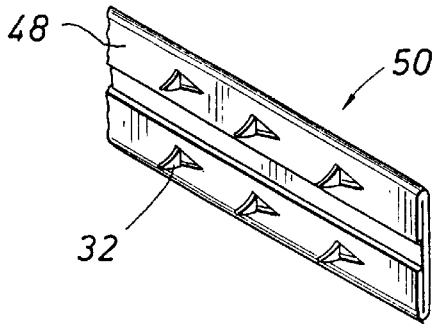
FIG. 22
FIG. 23
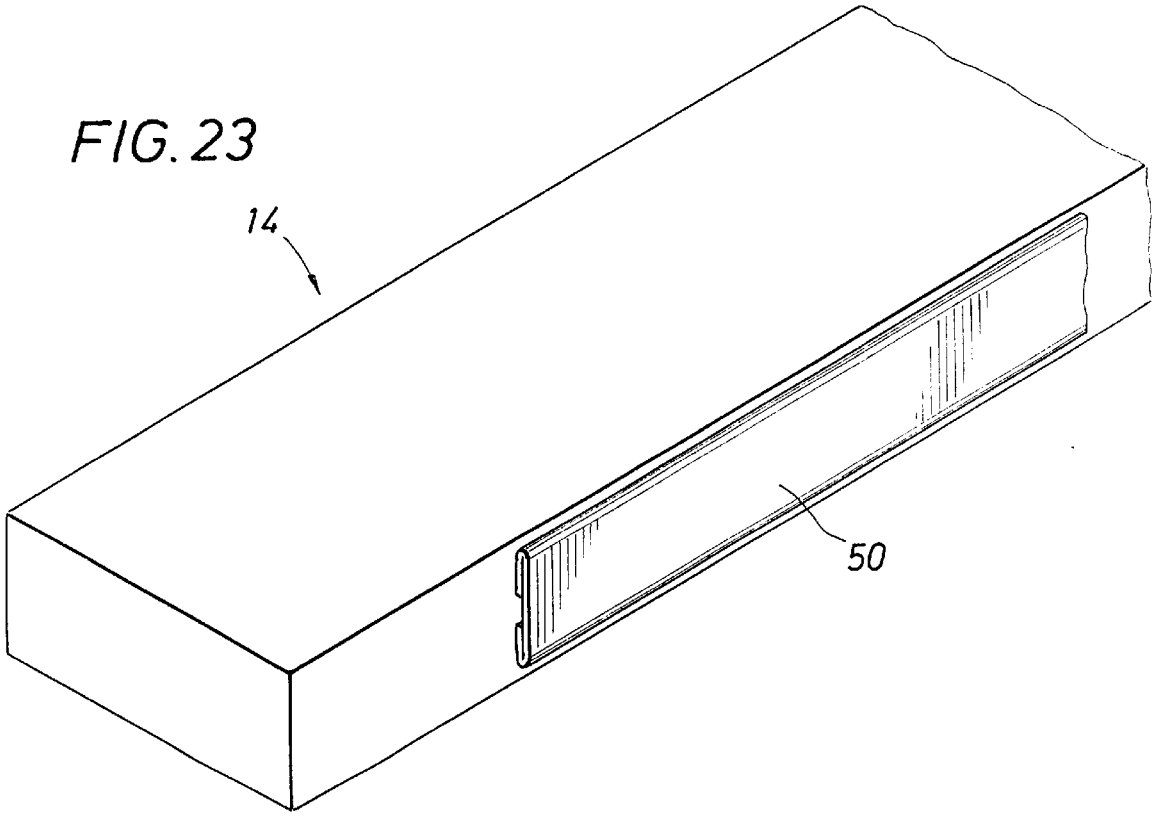
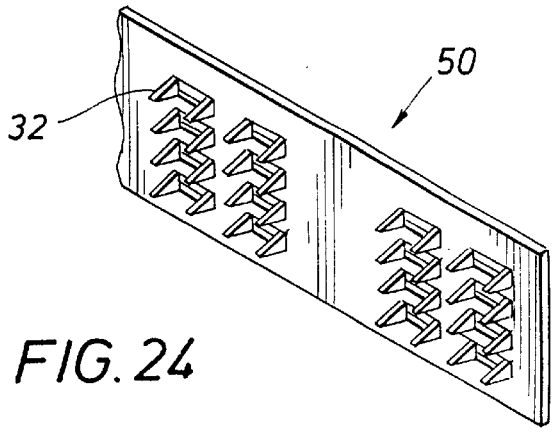
FIG. 24

FIG. 25
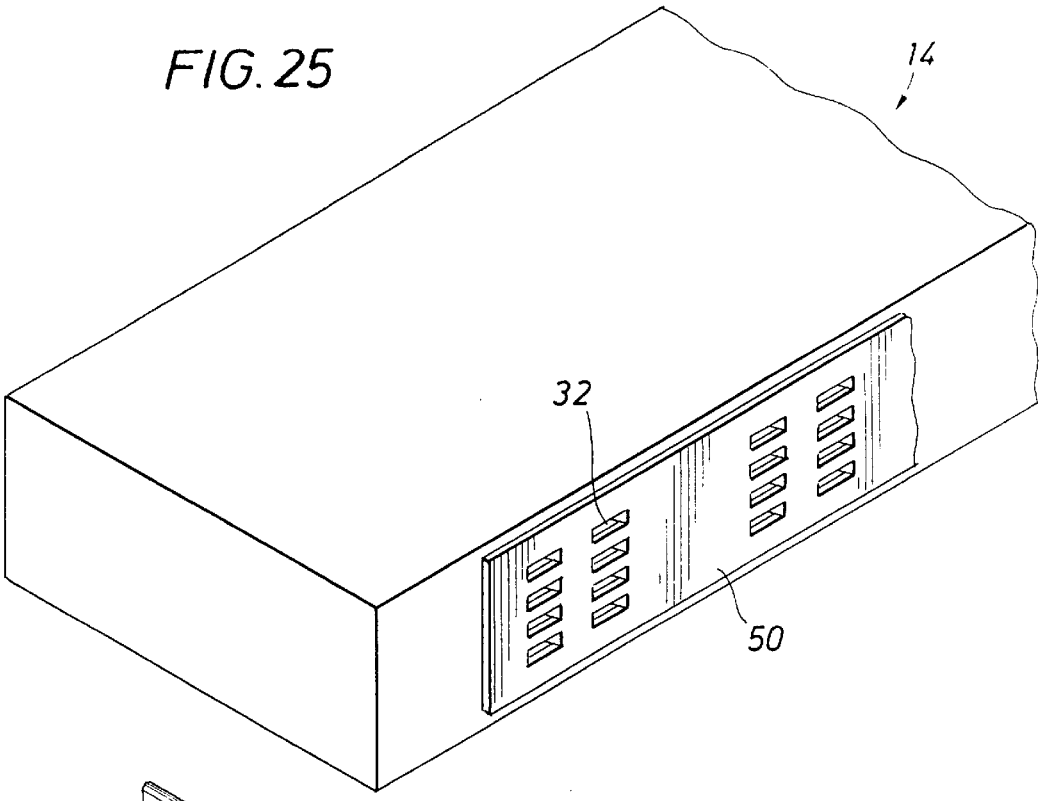
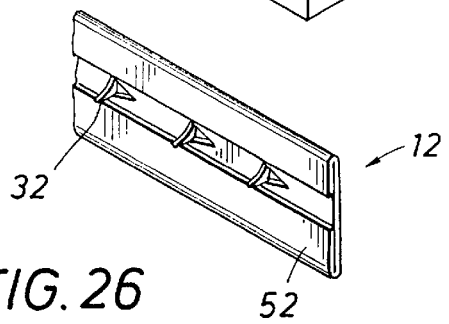
FIG. 26
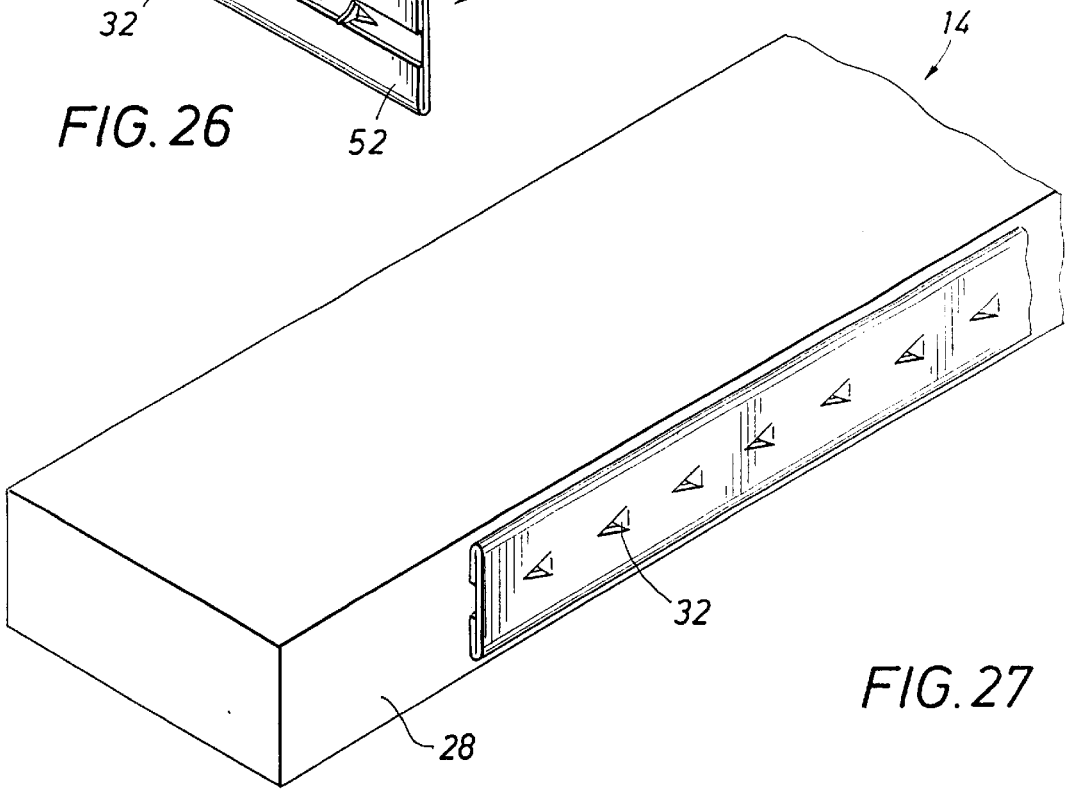
FIG. 27

FIG. 28
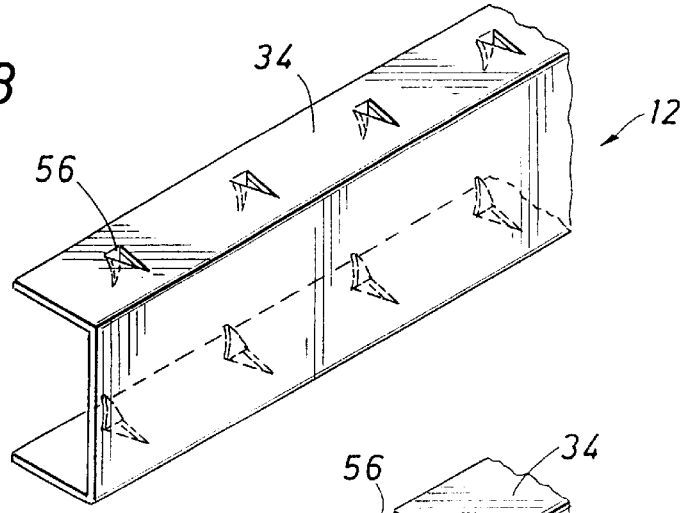
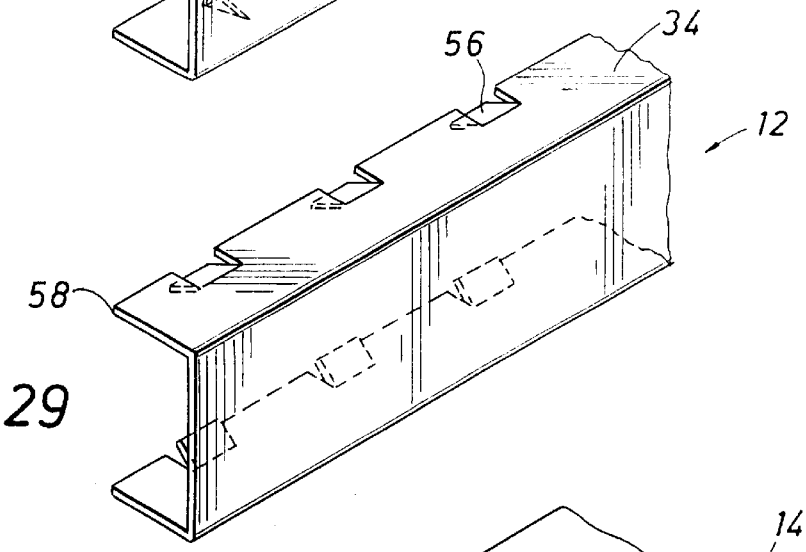
FIG. 29
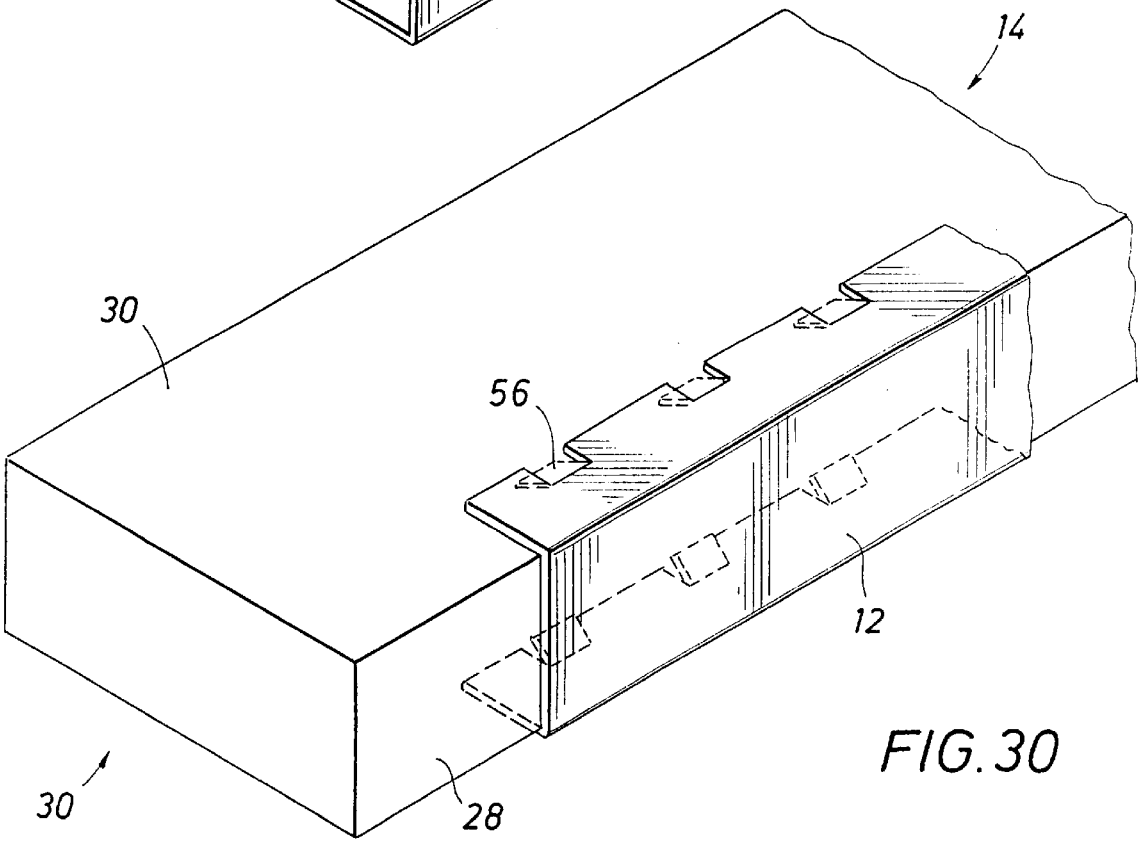
FIG. 30

PREFABRICATED WOOD TRUSSES WITH PRE-BRACED COMPRESSION WEB MEMBERS

FIELD OF THE INVENTION

This invention relates to prefabricated wood trusses or composite wood trusses and more particularly to braced prefabricated wood trusses.

BACKGROUND OF THE INVENTION

Prefabricated wooden roof trusses are more economical and much faster to construct than a conventional or "stick framed" roof structure. However, when prefabricated trusses are installed and receive loads, internal web members under compression can sometimes buckle, resulting in a possible truss failure.

To prevent web members from buckling, the on-site addition of permanent web bracing is required by industry standards. The purposes of bracing are to hold the vertical position of the truss, maintain the design spacing of the truss, and reduce the buckling length of web members under a compression load. Such bracing may be continuous lateral, "T" bracing or other specialized methods. When four or more like trusses are installed in parallel, continuous lateral bracing is generally specified to brace designated web members. The lateral bracing, in turn, is secured by permanent diagonal bracing or anchorage to a solid end wall or other means to prevent any instability. "T"-bracing is specified when less than four parallel-like trusses or web-like members are adjacent. Such bracing may be conventional lumber, such as a 2×4, that may be an 80% portion of the length of a designated web length. Multi-ply girder or widely spaced trusses require specialized bracing methods. In addition, top chord and vertical members in a wood truss may require lateral bracing or sheathing. Multiple bearing trusses or cantilever conditions may require bottom chord members which have compression forces that require bracing.

The above-referenced supplemental lateral or "T" bracing is specified by the truss designer. Moreover, such bracing of the prior art is furnished and installed at the job site by the builder/framer after the trusses are erected. On-site installation of web bracing, however, is complicated, costly, and time consuming. Further, often on-site web bracing is sometimes installed incorrectly and sometimes inadvertently omitted. When installing bracing on site (see prior art bracing in FIG. 1), conventional lumber must be taken to the truss webs and either nailed across the mid-points of the appropriate webs members with the beams anchored at the ends or secured by a diagonal brace, or "T" bracing is installed along each web.

Inspection of on-site bracing is being more closely scrutinized, with the result that builders are requesting the truss fabricator itself to inspect each building after installation of the trusses for proper bracing. Even though truss fabricators are the most capable inspectors, they find this an impossible burden. For example, in a typical multi-family (apartment) project, approximately 8,000 roof trusses may be used having 12,000 webs that require bracing.

The use of the "pre-braced" compression web of a wood truss of the instant invention will satisfy the requirements for structural integrity of installed prefabricated wood trusses while eliminating the need for compression web bracing at the job site. The instant invention promises to reduce construction time and costs and provide a more accurately braced roof system.

To eliminate having to install bracing at a job site, the instant invention teaches hardware for prefabricated wood trusses which may be attached to wood web members under compression which require bracing. Such bracing may be installed while a truss is being fabricated. Hence, inspection of the compression web bracing at the job site will not be required, as with prior art continuous lateral and/or "T" bracing. The hardware for pre-braced wood trusses is designed to reinforce truss web members to be placed in compression and prevent buckling when the truss receives a load. The hardware for pre-braced compression web of a wood truss is preferably made of metal and most preferably made of galvanized steel. The attached drawings show several embodiments of the possible designs and attachment means for the hardware for the pre-braced wood trusses of this invention. In addition, a range of lengths and various gauges of steel may be used for the hardware.

SUMMARY OF THE INVENTION

It has been discovered that installation of hardware for pre-braced wood trusses attached along at least a portion of a length of an interior wood compression web member of a truss eliminates the need for continuous lateral, diagonal or "T" bracing of a compression web member in such wood trusses. The hardware for pre-braced compression webs of wood trusses may be installed at the truss fabrication plant rather than at the job site as with prior art bracing methods. The hardware may be constructed of wood but is preferably of metal or galvanized steel. The gauge of steel may be heavier or lighter depending on the load conditions. The hardware for pre-braced compression webs of wood trusses is of sufficient length to reinforce at least a portion of an interior wood web compression member. The wood truss is typically a roof truss but the brace hardware and concept may be adapted to a floor truss or the like in which bracing is specified. The hardware for pre-braced compression webs of wood trusses is attached along at least one side of an interior wood web compression member and has one or more means for attachment to such member.

It is an object of this invention to provide a pre-braced compression web member of a wood truss having reinforcing hardware that may be attached to a side of an interior wood web member to receive a compression load where the hardware is installed at the truss fabrication plant. It is another object of this invention to provide a pre-braced compression web member of a wood truss having reinforcing hardware that may be attached to two or more adjacent sides of a wood web member receiving a compression load. Still another object of this invention is to provide a pre-braced compression web member of a wood truss having two or more hardware braces attached to the sides of a web member receiving a compression load. Still another object of this invention is to provide hardware for pre-braced compression webs of wood trusses having crimped end corners.

In this invention, prefabricated means prior to the installation of the wood truss at the designated location at the jobsite.

In each of the above objects of this invention, several means for attachment of the hardware for pre-braced compression webs of wood trusses to the compression web members are contemplated. The means for attachment, include but are not limited to, nail-like teeth, speed prong teeth, slotted teeth, and cut teeth, as well as nails, screws or fasteners, and the like. Additionally, the means for attachment to the pre-braced compression webs of wood trusses have several embodiments including means that are punched out or cut from the sides of the hardware or located on a flange of the hardware, or nailed or screwed though holes in the side of the hardware or other mechanical fasteners.

BRIEF DESCRIPTION OF THE DRAWINGS

This invention will be better understood and objects other than that set forth above will become apparent when consideration is given to the following detailed description thereof. Such description makes reference to the annexed drawings wherein:

FIG. 6 shows a sectional view of hardware for pre-braced compression webs of wood trusses installed on a truss web member and illustrates means for attaching the hardware to the web member including speed prong teeth. Further illustrated are a pair of hardware for pre-braced compression webs of wood trusses installed on opposing sides of the web member.

FIG. 7 shows an end view of hardware for pre-braced wood trusses of FIG. 6 and means for attachment including speed prong teeth that are punched out and formed from the sides of the hardware.

FIG. 8 shows an end view of hardware for pre-braced compression webs of wood trusses and illustrates hardware having crimped end corners.

FIG. 9 shows an end view of the hardware for pre-braced compression webs of wood trusses and illustrates hardware having double folded sides.

FIG. 18 is a sectional view of hardware for pre-braced compression webs of wood trusses having folded sides that is installed on two sides of a truss web member. Further illustrated are a pair of hardware for pre-braced compression webs of wood trusses installed on opposing sides of the web member.

FIG. 19 shows an end view of the hardware for pre-braced compression webs of wood trusses of FIG. 18 and illustrates attachment means including nail-like teeth punched out of the sides of the hardware.

FIG. 20 shows a sectional view of the hardware for pre-braced compression webs of wood trusses installed on a side of a truss web member.

FIG. 21 shows an end view of the hardware and illustrates means for attaching the hardware to the web member including pins or nails through holes on the sides of the hardware.

FIG. 22 shows an end view of the hardware for pre-braced compression webs of wood trusses having folded sides and illustrates means for attachment including nail-like teeth punched out of the folded sides.

FIG. 23 shows the hardware of FIG. 22 installed on a truss web member.

FIG. 24 shows an end view of the hardware for pre-braced compression webs of wood trusses having means for attachment including nail-like teeth punched out of the hardware.

FIG. 25 shows an end view of the hardware of FIG. 24 installed on a truss web member.

FIG. 26 shows an end view of the hardware for pre-braced compression webs of wood trusses having folded sides and nail-like teeth cut from the sides of the hardware.

FIG. 27 shows the hardware of FIG. 26 installed on a truss web member.

FIG. 28 shows an end view of the hardware for pre-braced compression webs of wood trusses having means for attachment including teeth that are cut out of sides of the hardware.

FIG. 29 shows an end view of the hardware for pre-braced compression webs of wood trusses having means for attachment including slotted teeth which are cut from the lips of the sides of the hardware.

FIG. 30 shows a sectional view of the hardware of FIG. 29 installed on a truss web member.

The drawings are not to operational scale, but rather are scaled to illustrate its features.

DESCRIPTION OF THE PREFERRED EMBODIMENTS OF THE INVENTION

Figure 1:
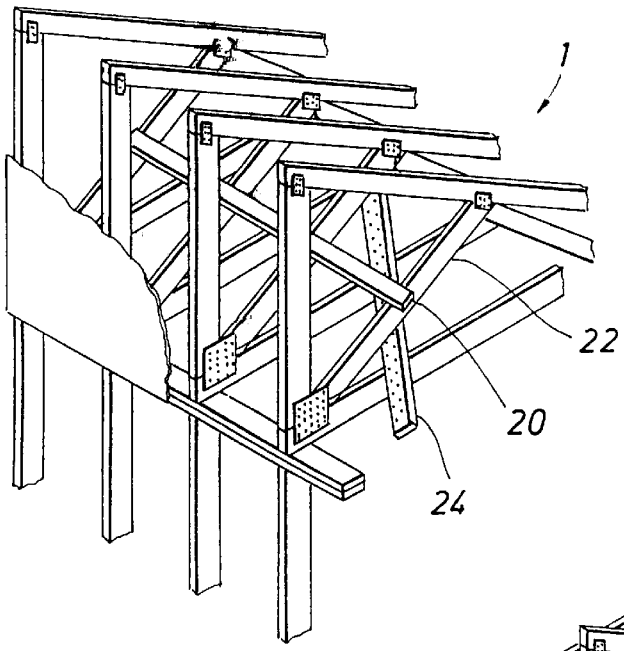
FIG. 1 (PRIOR ART)
FIG. 1 shows a roof truss having continuous lateral bracing of the prior art (industry standard), installed at the job site, and tied at the end to a diagonal brace.
Figure 2:
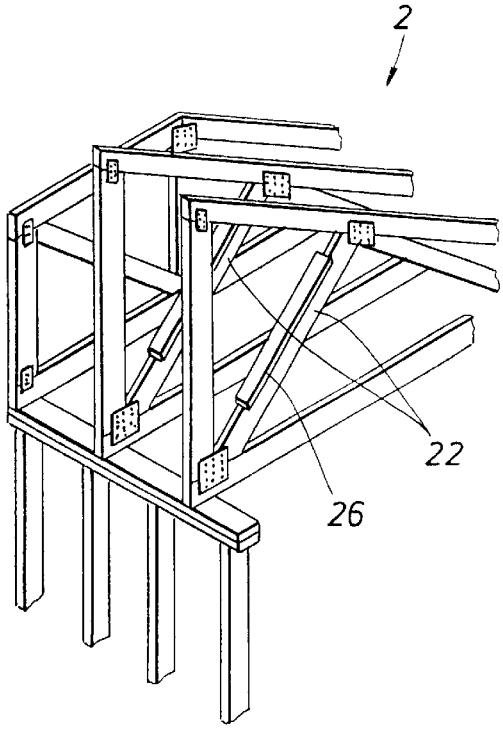
FIG. 2 (PRIOR ART)
FIG. 2 shows a roof truss having T-bracing of the prior art, installed at the job site.
Figure 3:
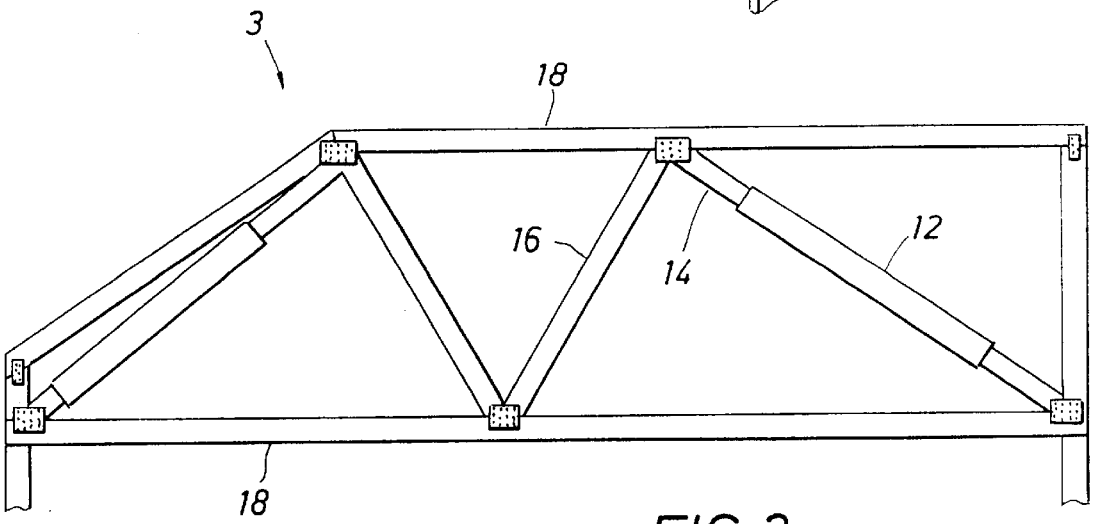
FIG. 3 shows a pre-fabricated wooden roof truss of the instant invention having pre-installed braces on interior web members to be placed under a compression load.

In the prior art, permanent bracing of wood trusses may be continuous lateral bracing 1 as shown in FIG. 1 or "T" bracing 2 as shown in FIG. 2. A conventional wood truss 3 is shown in FIG. 3 having chords 18 and interior web members 14 and 16. Also shown in FIG. 3 is the hardware 12 of the instant invention installed thereupon. In each of the following preferred embodiments, interior wooden web member 14 is under a compression load and is braced with hardware 12 of the instant invention. The pre-braced hardware 12 of this invention may be installed during fabrication of the truss 3 rather than on the job site as with prior art bracing methods.

In FIG. 1, a continuous lateral brace 20 of the prior art is shown connecting parallel web members 22 of a truss. Continuous lateral bracing is used to prevent buckling and stabilize truss spacing when there are four or more trusses in a row. Also shown is a prior art diagonal brace 24 which is used to stabilize the lateral bracing. In FIG. 2, a "T" brace 26 of the prior art is shown installed upon web members 22 of a truss. The installation of these prior art bracing structures—continuous lateral, diagonal, and "T" bracing—are performed on the job site and must be inspected after construction. In the instant invention, however, the braces for wood trusses are preinstalled before the truss is erected at the job site, hence eliminating the need for job site bracing and inspection.

Figure 4:
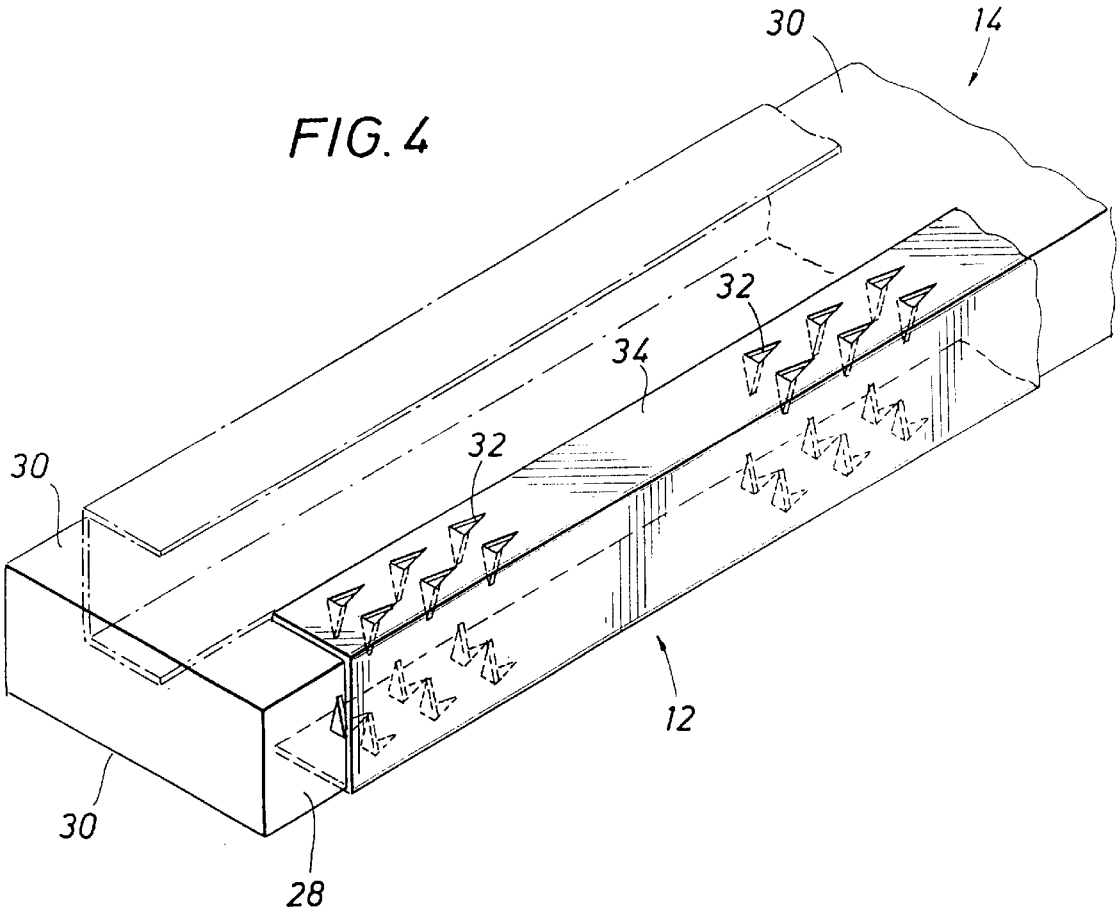
FIG. 4 shows a sectional view of hardware for pre-braced compression webs of wood trusses installed on a web member and illustrates means for attaching the hardware to the web member including nail-like teeth. Further illustrated are a pair of hardware for pre-braced compression webs of wood trusses installed on opposing sides of the web; member.
Figure 5:
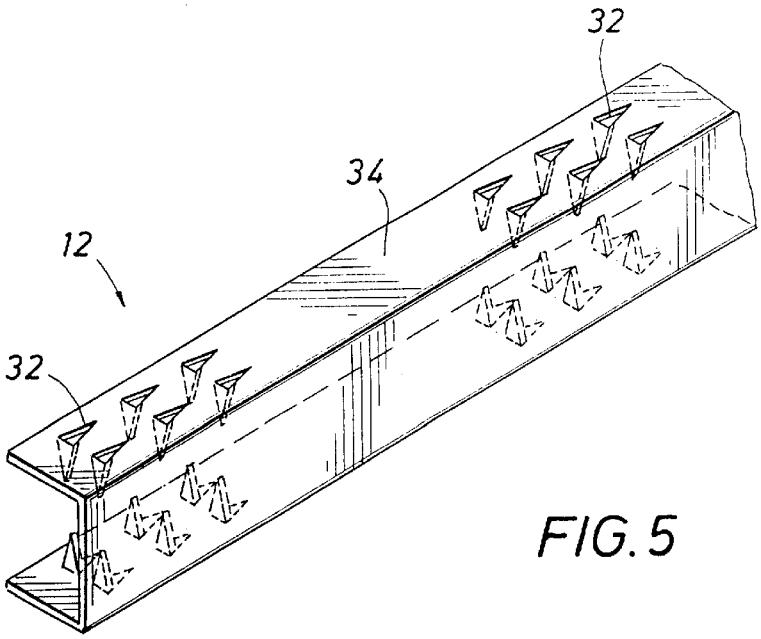
FIG. 5 shows an end view of hardware for pre-braced compression webs of wood trusses of FIG. 4 and means for attachment including nail-like teeth that are punched out of the sides of the hardware.
Figure 10:
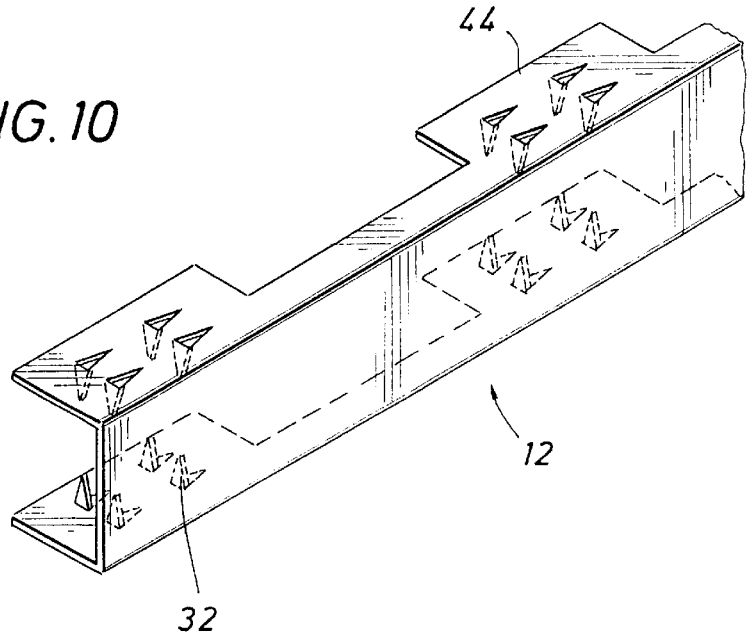
FIG. 10 shows an end view of a the hardware for pre-braced compression webs of wood trusses having a flange including nail-like teeth that are punched out of the flange.
Figure 11:
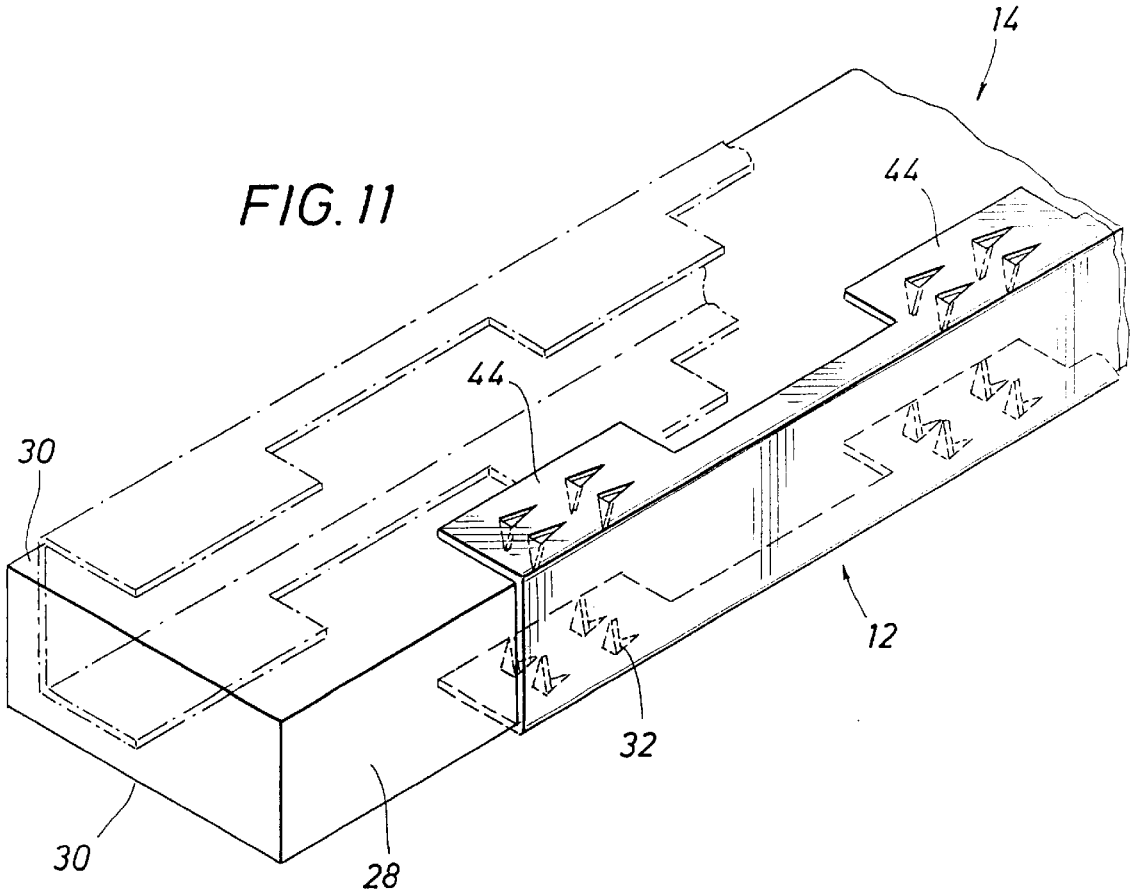
FIG. 11 show the hardware of FIG. 10 installed on a truss web member. Further illustrated are a pair of hardware for pre-braced compression webs of wood trusses installed on opposing sides of the web member.
Figure 12:
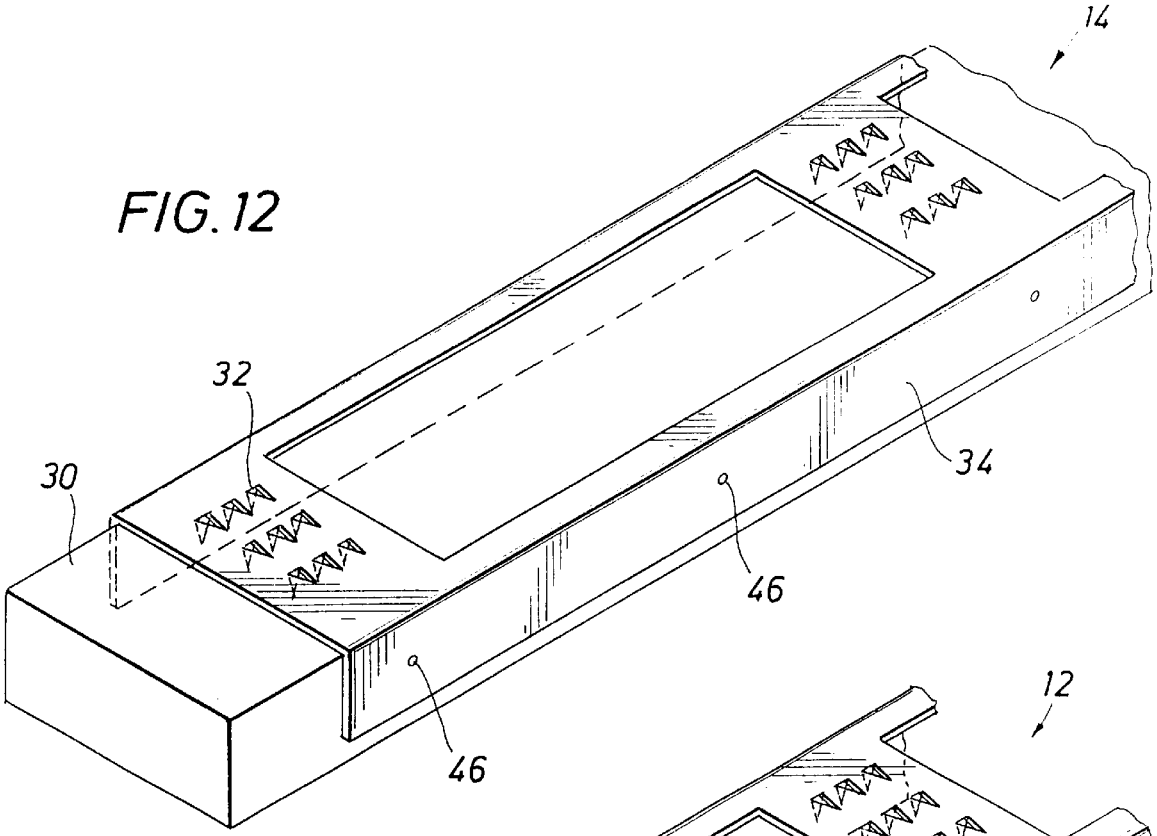
FIG. 12 shows a sectional view of hardware for pre-braced compression webs of wood trusses installed on three adjacent sides of a web member.
Figure 13:
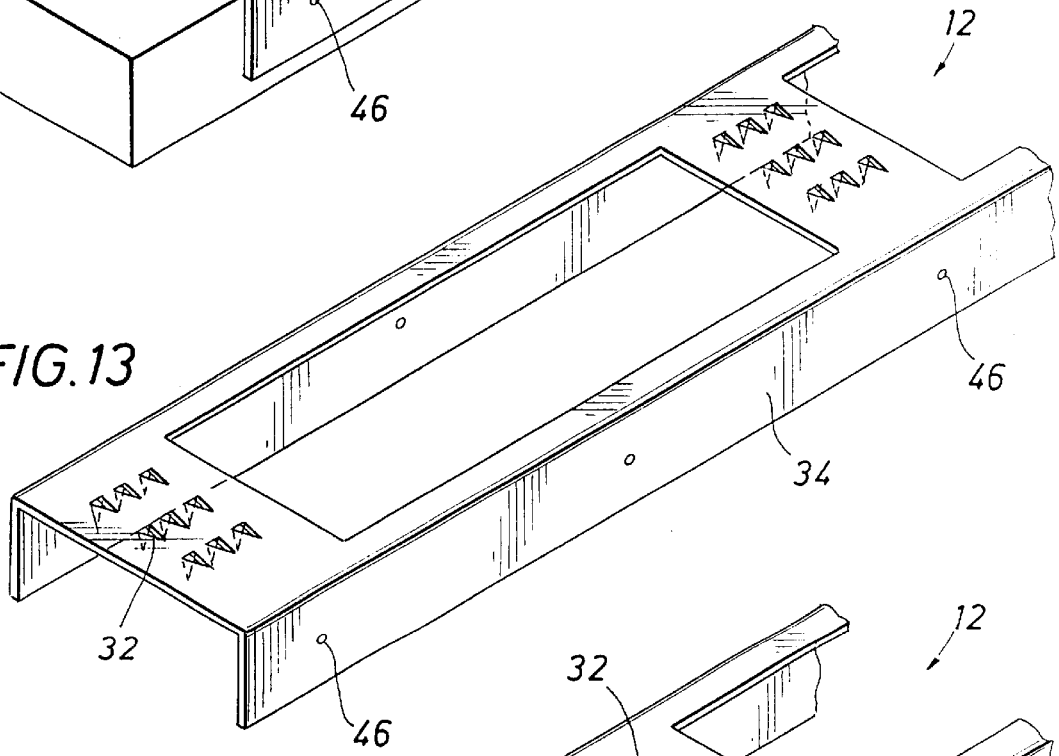
FIG. 13 shows an end view of the hardware of FIG. 12 and illustrates means for attaching the hardware to the sides of the web member including nail-like teeth that are punched out of the sides of the hardware.
Figure 14:
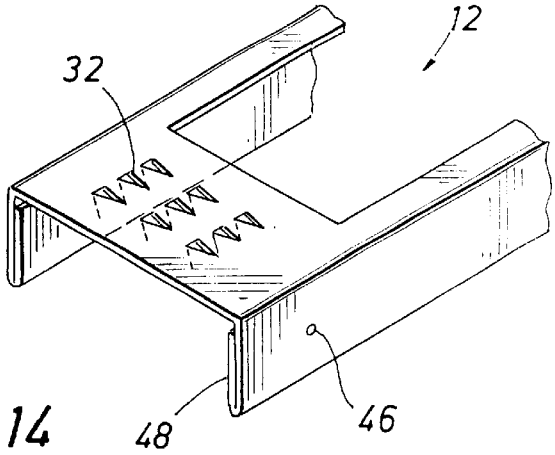
FIG. 14 shows a feature of the hardware for pre-braced compression webs of wood trusses of FIG. 13 having folded sides.

The remaining drawings, FIGS. 4 through 25, show preferred embodiments and means for attachment of the instant invention. The hardware 12 for pre-braced compression webs of wood trusses may be installed on three adjacent sides of truss web member 14. As shown in FIG. 4, the hardware 12 for pre-braced trusses of the instant invention is installed upon side 28 and each adjacent side 30 of web member 14 by means of nail-like teeth 32. In FIG. 5, the nail-like teeth 32 are shown as punched from each side 34 of hardware 12. In FIG. 6, hardware 12 is attached to web member 14 by means of speed prong teeth 36. The speed prong teeth 36, shown in FIG. 7, are punched and formed from each side 34 of hardware 12. Another preferred embodiment of the instant invention is shown in FIG. 8 where each side 34 and side 38 of hardware 12 comprise crimped corners 40. FIG. 9 reveals still another preferred embodiment of the invention, where hardware 12 is shown as having double fold 42 in side 38. Also shown are means for attachment which include nail-like teeth 32 punched from each side 34 of hardware 12. In FIG. 10, the means for attachment of hardware 12 to each adjacent side 30 of web member 14 is shown as flanges 44 having nail-like teeth 32 punched out of the flange 44 of hardware 12. In FIG. 11, hardware 12 is installed on side 30 of web member 14 by means of nail-like teeth. In FIGS. 12, 13 and 14, the hardware is shown in an alternative arrangement wherein it may be installed along a side of web member 14. FIG. 14 shows an additional feature of the hardware 12 of FIG. 13 as having folded sides 48 and including attachment means of nail-like teeth 32 and holes 46.

Figure 15:
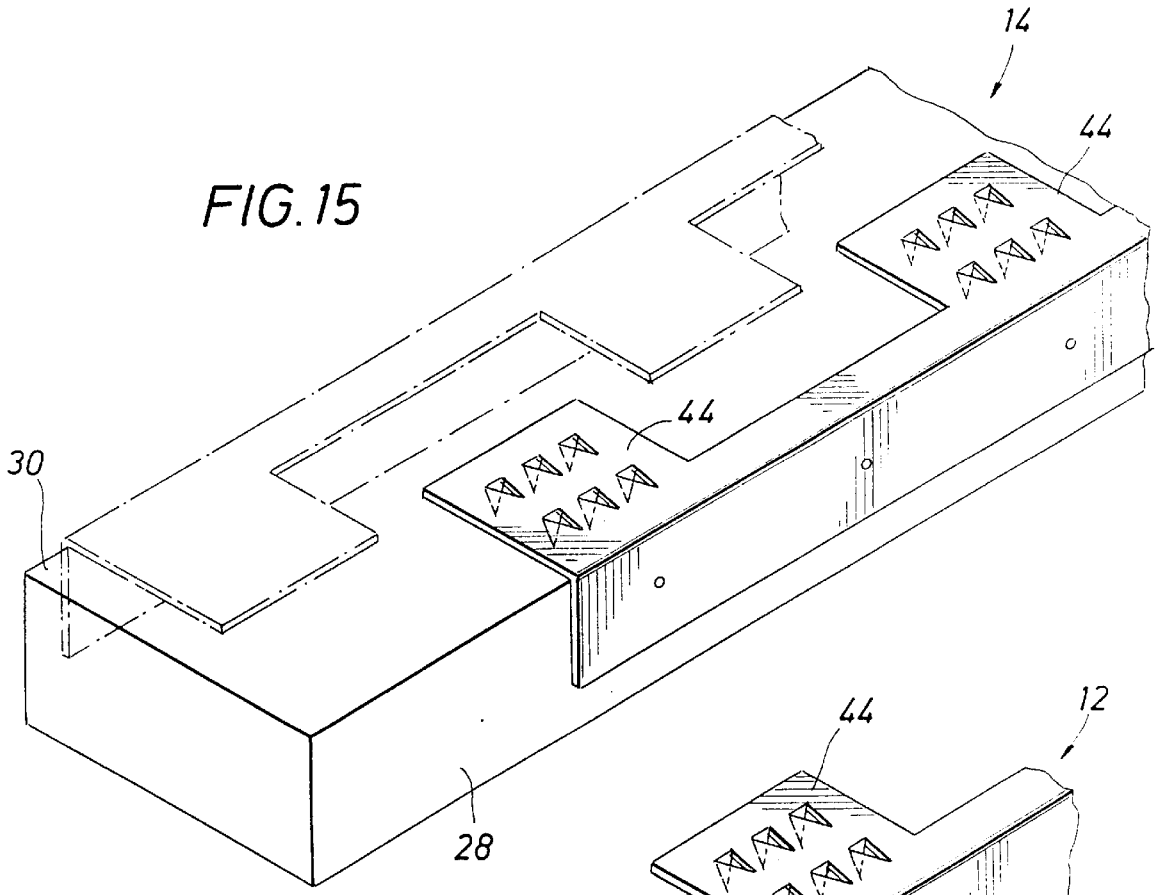
FIG. 15 shows a sectional view of hardware for pre-braced compression webs of wood trusses that is installed on two sides of a web member. Further illustrated are a pair of hardware for pre-braced compression webs of wood trusses installed on opposing sides of the web member.
Figure 16:
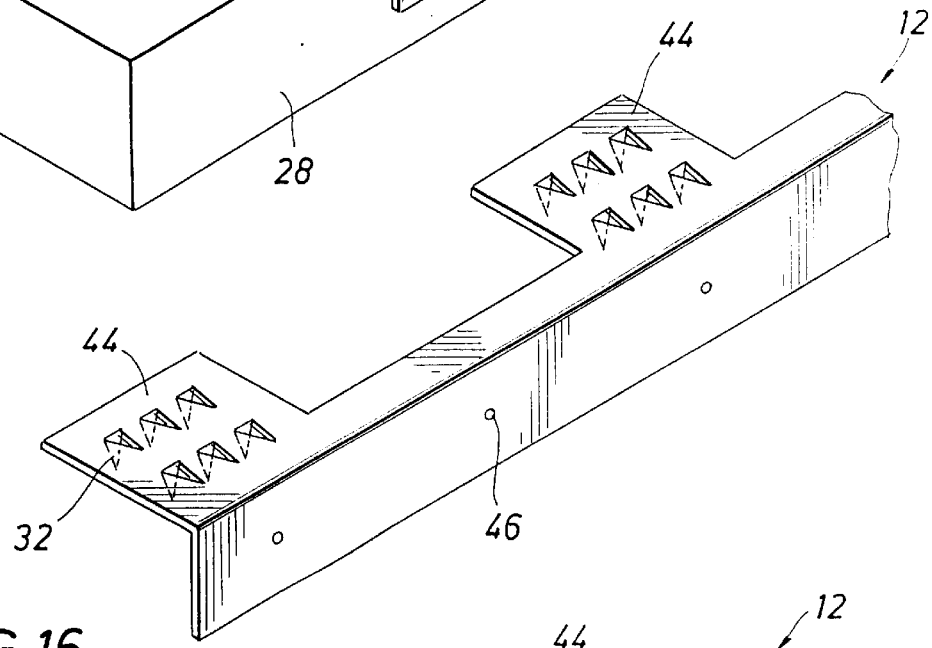
FIG. 16 shows an end view of the hardware of FIG. 15 and illustrates means for attaching the hardware to the web member including a flange having nail-like teeth that are punched out from the flange.
Figure 17:
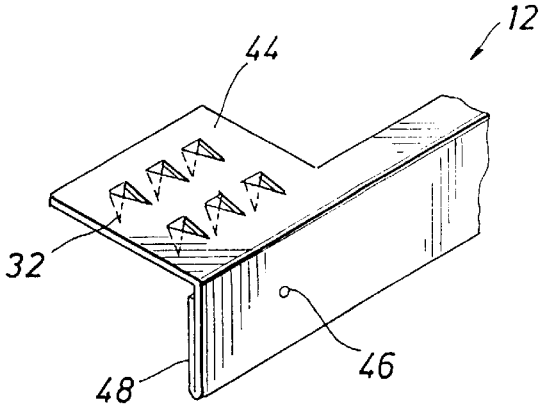
FIG. 17 shows the hardware for pre-braced compression webs of wood trusses of FIG. 16 having folded sides.

In still another preferred embodiment of the instant invention, the hardware 12 for pre-braced compression webs of wood trusses may be installed on two sides of truss web member 14. FIG. 15 shows hardware 12 bracing side 28 of web member 14 by flanges 44 that are attached to side 30 of web member 14 by means of nail-like teeth punched out of flanges 44. In addition, holes 46 may be used for receiving further attachment means. FIG. 16 shows the features of hardware 12 of FIG. 15. FIG. 17 shows an additional feature of the hardware 12 that is shown in FIG. 16 as having a folded side 48 and includes nail-like teeth 32 in flange 44 and holes 46. FIG. 19 shows an alternative means for attachment of the hardware that is shown in FIG. 17 that includes nail-like teeth 32 along the side 32 of hardware 12. FIG. 18 shows the hardware 12 of FIG. 19 installed on web member 14.

Still another preferred embodiment of the instant invention, the hardware 12 for pre-braced compression webs of wood trusses may be installed on a single side of truss web member 14. In FIG. 21, the hardware 12 is shown as a side brace 50 and having double folded sides 52 and holes 46 through which nails 54 or the like are used as attachment means. In FIG. 20, the side brace 50 is shown installed on web member 14. FIG. 22 shows additional attachment means for side brace 50 as nail-like teeth 32 that are punched out of the folded sides 48. FIG. 23 shows the hardware 12 of FIG. 22 installed on a web member. In FIG. 24, the edge brace 50 is shown as having attachment means of nail-like teeth 32 punched from the ends of the brace. The edge brace 50 is shown installed on a web member 14 in FIG. 25. In FIG. 26, the hardware 12 is shown as a side brace 50 having folded sides 52 and nail-like teeth 32 as attachment means that are punched out of side brace 50. In FIG. 27, the hardware 12 of FIG. 26 is shown installed on side 28 of web member 14.

Alternative means for attachment of hardware 12 to web member 14 may be cut teeth 56 as shown in FIGS. 28 and 29. In FIG. 28, the cut teeth 56 are shown as cut from side 34 of hardware 12 away from lip 58. In FIG. 29, the cut teeth 56 are shown as cut from lip 58 of side 34 of hardware 12. The hardware 12 having cut teeth 56 of FIG. 28 is shown bracing side 28 of web member 14 in FIG. 30.

Figure 31:
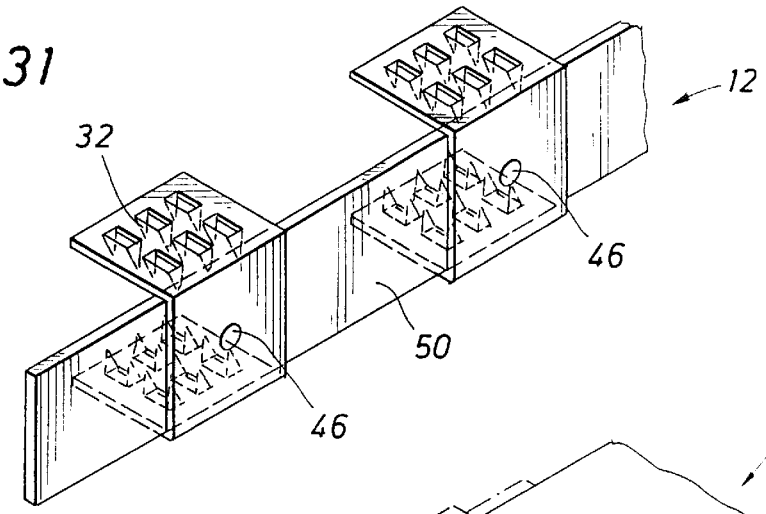
FIG. 31 shows an end view of hardware for pre-braced compression webs of wood trusses as a two-piece member having means for attachment to web members via nail-like teeth and means for attachment to other brace hardware.
Figure 32:
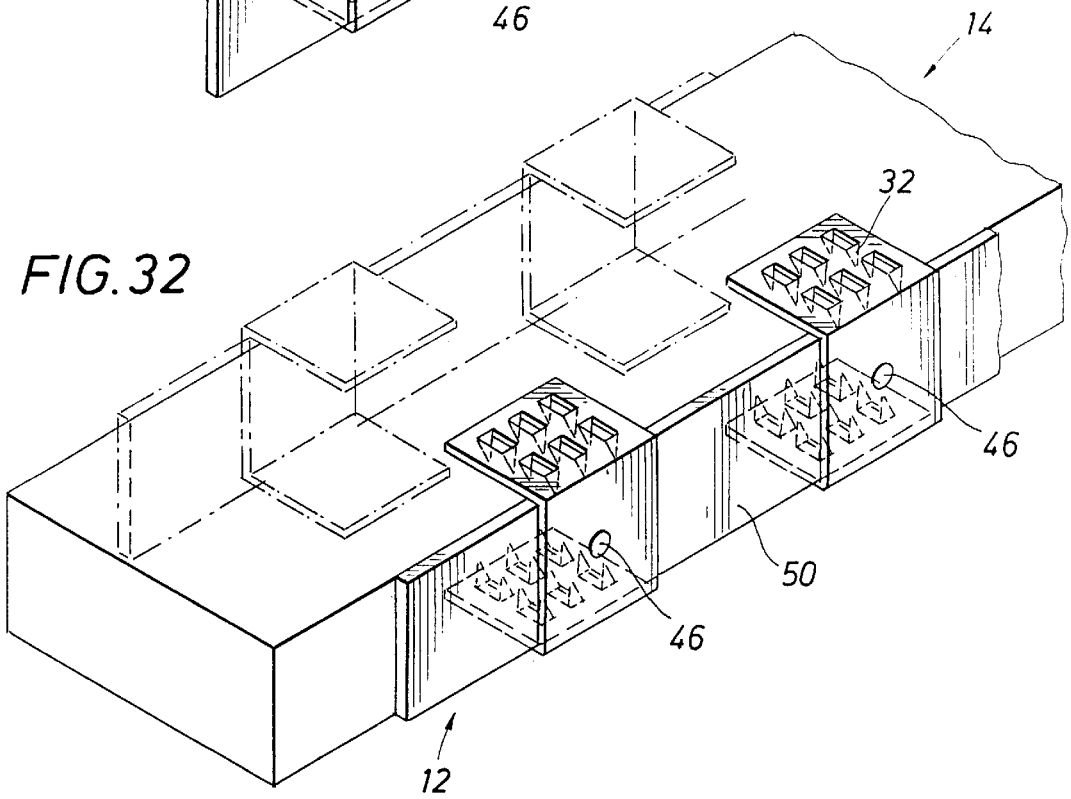
FIG. 32 shows a sectional view of the hardware of FIG. 31 installed on a truss web member. Further illustrated are a pair of hardware for pre-braced compression webs of wood trusses installed on opposing sides of the web member.

In still another preferred embodiment of the instant invention, hardware 12 is shown in FIG. 31 as a two-piece member having means for attaching to web member 14 via nail-like teeth 32 and having means for attaching to side brace 50 via holes 46. In FIG. 32, the hardware 12 of FIG. 31 is shown installed on truss web member 14.

Figure 33:
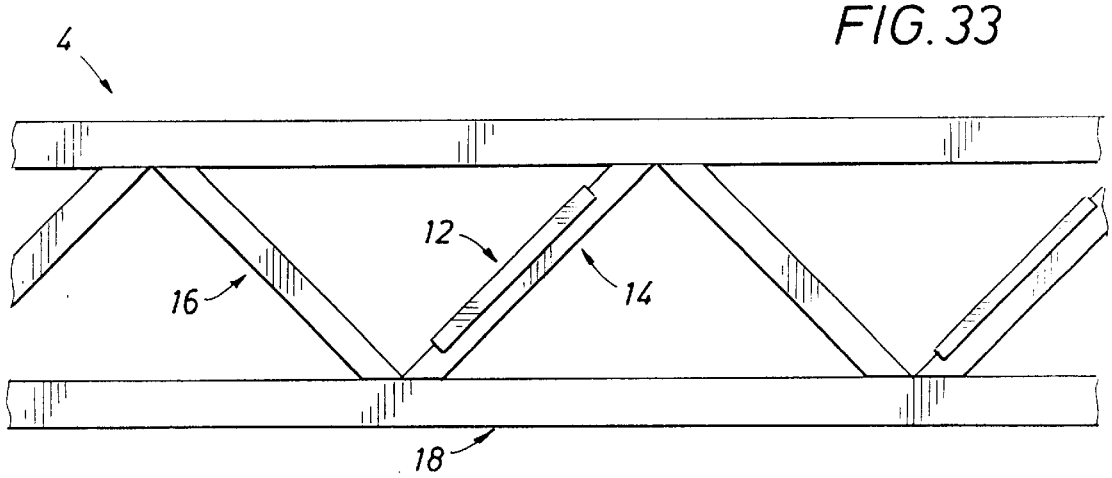
FIG. 33 shows a sectional view of hardware for pre-braced compression webs of wood trusses installed on a conventional wooden floor truss.

FIG. 33 reveals still another preferred embodiment of the instant invention wherein a floor truss 4 is shown having hardware for pre-braced compression webs of wood trusses 12 installed upon a web member 14.

In any of the above embodiments of the above invention, namely as shown in FIG. 4, FIG. 6, FIG. 11, FIG. 15, FIG. 18, FIG. 20, FIG. 23, FIG. 25, FIG. 27, FIG. 30 and FIG. 32 a pair of hardware 12 for pre-braced compression webs of wood trusses may be installed on one or more sides of a web member 14. The holes which are shown in FIGS. 12–17, FIG. 20–21, and FIG. 32 may receive a nail, rivet, or locator pin, or the like. Further, the nail, rivet or locator pin, or the like may be supplied as an integral part of the hardware or supplied separately.

While there are shown and described present preferred embodiments of the invention, it is to be distinctly understood that the invention is not limited thereto, but may be otherwise variously embodied and practiced with the scope of the following claims, ACCORDINGLY, It is claimed:

1. A prefabricated wood truss with a pre-braced compression web, comprising:

a prefabricated wood truss having at least one reinforcing brace with at least three-fourths of a brace length attached along at least 30% of a central portion of a length of an interior wood web member structure to be placed in compression.

2. A prefabricated wood truss with a pre-braced compression web, comprising:

a prefabricated wood truss having at least one reinforcing brace attached along at least 30% of a portion of a length of an interior wood web member structured to be placed in compression, the brace and web member structured in combination such that the brace does not extend longitudinally beyond the web member.

3. A prefabricated wood truss with a pre-braced compression web, comprising:

a prefabricated wood truss having at least one reinforcing brace attached along at least 30% of a central portion of a length of an interior wood web member structured to be placed in compression, and attached along less than 100% of the web member length.

4. The truss of claims 1, 2 or 3 wherein the interior wooden web member comprises a unitary member.

5. The truss of claims 1, 2 or 3 wherein the brace is comprised of galvanized steel.

6. The truss of claims 1, 2 or 3 wherein the brace is attached to at least two adjacent sided of the web member.

7. The truss of claim 6 having two or more braces wherein each brace is attached to at lest two adjacent sides of a web member.

8. The truss of claims 1, 2 or 3 wherein the brace is attached along at least three adjacent sides of a web member.

9. The truss of claim 8 having two or more braces wherein each brace is attached to at least three adjacent sides of a web member.

10. The truss of claims 1, 2 or 3 wherein the brace contains means for attachment to the web member.

11. The truss of claims 1, 2 or 3 wherein the brace is attached over a center portion of the web member.

12. The truss of claims 1, 2 or 3 wherein the brace is attached along at least 50% of a portion of the member.

13. The truss of claims 1, 2 and 3 wherein the brace has a double reinforcing wall for the web member.

14. A method for providing a prefabricated wood truss with a pre-braced compression web, comprising:

attaching, prior to installing the truss, at least three-fourths of a length of a reinforcing brace along at least a central and substantial portion of an interior web member structured to be placed in compression.

15. A method for providing a prefabricated wood truss with a pre-braced compression web, comprising:

attaching, prior to installing the truss, a reinforcing brace along at least a substantial portion of an interior web member structured to be placed in compression with the brace not extending longitudinally beyond the web member.

16. A method for providing a prefabricated wood truss with a pre-braced compression web, comprising:

attaching, prior to installing the truss, a reinforcing brace along at least a substantial and central portion of an interior web member structured to be placed in compression and attaching the brace along less than 100% of the length of the web member.

* * * * *